US008393869B2

(12) United States Patent
Kim et al.

(10) Patent No.: US 8,393,869 B2
(45) Date of Patent: Mar. 12, 2013

(54) TURBINE BLADE ASSEMBLY INCLUDING A DAMPER

(75) Inventors: Hyun Dong Kim, San Diego, CA (US); Yungmo Kang, San Diego, CA (US); Yong Weon Kim, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 655 days.

(21) Appl. No.: 12/318,010

(22) Filed: Dec. 19, 2008

(65) Prior Publication Data

US 2010/0158686 A1 Jun. 24, 2010

(51) Int. Cl.
*F01D 5/18* (2006.01)

(52) U.S. Cl. ..... 416/219 R; 416/226; 416/231 R; 416/239; 416/248

(58) Field of Classification Search ..... 415/115, 415/116; 416/95, 96 A, 97 R, 190, 193 A, 416/219 R, 223 R, 224, 226, 231 R, 239, 416/248, 500

See application file for complete search history.

(56) References Cited

U.S. PATENT DOCUMENTS

| | | | | |
|---|---|---|---|---|
| 2,912,223 | A | 11/1959 | Hull, Jr. | |
| 3,112,915 | A | 12/1963 | Morris | |
| 3,610,778 | A | 10/1971 | Suter | |
| 3,666,376 | A | 5/1972 | Damlis | |
| 3,709,631 | A | 1/1973 | Karstensen et al. | |
| 3,723,023 | A * | 3/1973 | Crick | 416/219 R |
| 3,751,183 | A | 8/1973 | Nichols et al. | |
| 3,918,842 | A | 11/1975 | Longley et al. | |
| 4,872,812 | A | 10/1989 | Hendley et al. | |
| 4,936,749 | A | 6/1990 | Arrao et al. | |
| 5,161,949 | A | 11/1992 | Brioude et al. | |
| 5,201,849 | A * | 4/1993 | Chambers et al. | 416/95 |
| 5,228,835 | A | 7/1993 | Chlus | |
| 5,339,619 | A | 8/1994 | Antonellis | |
| 5,369,882 | A * | 12/1994 | Dietz et al. | 29/889.1 |
| 5,388,962 | A | 2/1995 | Wygle et al. | |
| 5,415,526 | A | 5/1995 | Mercadante et al. | |
| 5,478,207 | A | 12/1995 | Stec | |
| 5,513,955 | A | 5/1996 | Barcza | |
| 5,573,375 | A * | 11/1996 | Barcza | 416/193 A |
| 5,599,170 | A * | 2/1997 | Marchi et al. | 416/190 |
| 5,800,124 | A * | 9/1998 | Zelesky | 416/95 |
| 6,193,465 | B1 * | 2/2001 | Liotta et al. | 416/96 A |
| 6,273,683 | B1 | 8/2001 | Zagar et al. | |

(Continued)

FOREIGN PATENT DOCUMENTS

| | | |
|---|---|---|
| EP | 0 490 522 A1 | 6/1992 |
| EP | 0490522 | 6/1992 |

(Continued)

OTHER PUBLICATIONS

International Search Report in International Application No. PCT/US2009/068721, dated Dec. 4, 2010.

*Primary Examiner* — Michael Lebentritt
(74) *Attorney, Agent, or Firm* — Finnegan, Henderson, Farabow, Garrett & Dunner LLP

(57) ABSTRACT

A damper for a turbine rotor assembly of a gas turbine engine is disclosed. The damper may have a forward plate. The damper may further have an aft plate including a larger surface area than the forward plate. The aft plate may have at least one aperture for regulating a flow of through the aft plate. The damper may also have a longitudinal structure connecting the forward plate and the aft plate.

20 Claims, 6 Drawing Sheets

U.S. PATENT DOCUMENTS

| | | | | |
|---|---|---|---|---|
| 6,283,707 | B1 * | 9/2001 | Chin | 416/96 A |
| 6,354,803 | B1 | 3/2002 | Grover et al. | |
| 6,450,769 | B2 | 9/2002 | Szwedowicz | |
| 6,478,544 | B2 | 11/2002 | Brandl et al. | |
| 6,851,932 | B2 | 2/2005 | Lagrange et al. | |
| 6,932,575 | B2 | 8/2005 | Surace et al. | |
| 7,090,466 | B2 | 8/2006 | Honkomp et al. | |
| 7,097,429 | B2 | 8/2006 | Athans et al. | |
| 7,104,758 | B2 | 9/2006 | Brock et al. | |
| 7,121,800 | B2 * | 10/2006 | Beattie | 416/190 |
| 7,121,801 | B2 * | 10/2006 | Surace et al. | 416/193 A |
| 7,121,802 | B2 | 10/2006 | Athans et al. | |
| 7,244,101 | B2 * | 7/2007 | Lee et al. | 416/97 R |
| 7,322,797 | B2 * | 1/2008 | Lee et al. | 416/193 A |
| 7,367,123 | B2 | 5/2008 | Itzel et al. | |
| 7,371,428 | B2 * | 5/2008 | Russo et al. | 427/250 |
| 7,374,400 | B2 * | 5/2008 | Boswell | 416/97 R |
| 8,011,892 | B2 * | 9/2011 | Ramlogan et al. | 416/190 |
| 2004/0028529 | A1 | 2/2004 | Austin et al. | |
| 2006/0056975 | A1 | 3/2006 | Honkomp et al. | |
| 2006/0120875 | A1 * | 6/2006 | Surace et al. | 416/248 |
| 2007/0077144 | A1 * | 4/2007 | Lee et al. | 416/193 A |
| 2007/0134099 | A1 * | 6/2007 | Lee et al. | 416/193 A |
| 2008/0025842 | A1 | 1/2008 | Marini et al. | |
| 2009/0116953 | A1 * | 5/2009 | Spangler et al. | 415/115 |
| 2010/0061854 | A1 * | 3/2010 | Townes et al. | 416/95 |
| 2010/0111700 | A1 * | 5/2010 | Kim et al. | 416/219 R |
| 2010/0239426 | A1 * | 9/2010 | Westergaard | 416/226 |

FOREIGN PATENT DOCUMENTS

| | | |
|---|---|---|
| EP | 1 617 044 A1 | 1/2006 |
| EP | 1617044 | 1/2006 |
| JP | 10252413 | 9/1998 |
| KR | 1020050083579 | 8/2005 |
| KR | 1020060089649 | 8/2006 |

* cited by examiner

TURBINE BLADE ASSEMBLY INCLUDING A DAMPER

TECHNICAL FIELD

The present disclosure relates generally to a turbine damper and, more particularly, to a turbine damper for regulating the flow of gas around a turbine blade assembly.

BACKGROUND

A gas turbine engine ("GTE") is known to include one or more stages of turbine rotor assemblies mounted on a drive shaft. Each turbine rotor assembly includes a plurality of turbine blades extending radially outward and spaced circumferentially from one another around a turbine rotor. The GTE ignites a mixture of air/fuel to create a flow of high-temperature compressed gas over the turbine blades, which causes the turbine blades to rotate the turbine rotor assembly. Rotational energy from each turbine rotor assembly may be transferred to the drive shaft to power a load, for example, a generator, a compressor, or a pump.

A turbine blade typically includes a root structure and an airfoil extending from opposite sides of a turbine blade platform. The turbine rotor is known to include a slot for receiving each turbine blade. The shape of each slot may be similar in shape to the root structure of each corresponding turbine blade. When a plurality of turbine blades are assembled on the turbine rotor, an under-platform cavity may be formed between and/or beneath turbine platforms of adjacent turbine blades. An ingress of high-temperature compressed gas into the under-platform cavity through a gap between adjacent turbine blade platforms may cause premature fatigue of turbine blades due to excessive heat.

Various systems and components for regulating the flow of compressed gas around turbine rotor assemblies are known. Some systems are known to utilize a damper positioned between turbine blades to regulate the flow of gas within a turbine rotor assembly. Further, it is known to use a moveable element to bridge the gap between adjacent turbine blade platforms. In some cases, it is also known to utilize a damper in combination with a moveable element.

One example of a system including a seal body positioned between adjacent turbine blades to regulate a flow of gases around a turbine rotor stage is described in U.S. Pat. No. 7,097,429 to Athans et al. ("the '429 patent"). The '429 patent discloses a rotor disk including a plurality of turbine blades. Each turbine blade includes an airfoil, a platform, and a shank. The shank may extend down to a multilobe dovetail to mounted the turbine blade to the rotor disk. The seal body is positioned between the shanks and below the platforms of adjacent turbine blades. The seal body includes an enlarged seal plate disposed at a forward end of the seal body. The enlarged plate overlaps forward faces of adjacent shanks to provide a seal. The seal body also seals at an aft end with a rectangular head disposed above a pair of axial lobes or tangs. The enlarged plate includes a small inlet aperture for metering a small amount of purge air between the shanks during operation to control the disk temperature.

Although the system of the '429 patent may disclose using a seal body between shanks of adjacent turbine blades, certain disadvantages persist. For example, the seal body of the '429 patent discloses small head on the aft end that may be prone to gas leakage. Further, the seal body of the '429 patent does not permit a flow of cooling gas to be regulated around an outer edge of the enlarged seal plate at the forward face of the turbine shanks.

SUMMARY

In one aspect, the present disclosure is directed to a damper for a turbine rotor assembly of a gas turbine engine. The damper may include a forward plate. The damper may further include an aft plate including a larger surface area than the forward plate. The aft plate may include at least one aperture for regulating a flow of gas through the aft plate. The damper may also include a longitudinal structure connecting the forward plate and the aft plate.

In another aspect, the present disclosure is directed to method of regulating a first flow of gases and a second flow of gases within a turbine rotor assembly, wherein the turbine rotor assembly includes a pair of turbine blades and a damper mounted on a turbine rotor. The method may include permitting a first amount of the first flow of gases to flow past a forward plate of the damper and enter an under-platform cavity that is formed between the pair of turbine blades and an outer circumferential edge of the turbine rotor. The method further may include regulating a second amount of the first flow of gases from exiting the under-platform cavity, such that a positive pressure is generated in the under-platform cavity to suppress the second flow of gases from entering the under-platform cavity.

DETAILED DESCRIPTION

Figure 1:
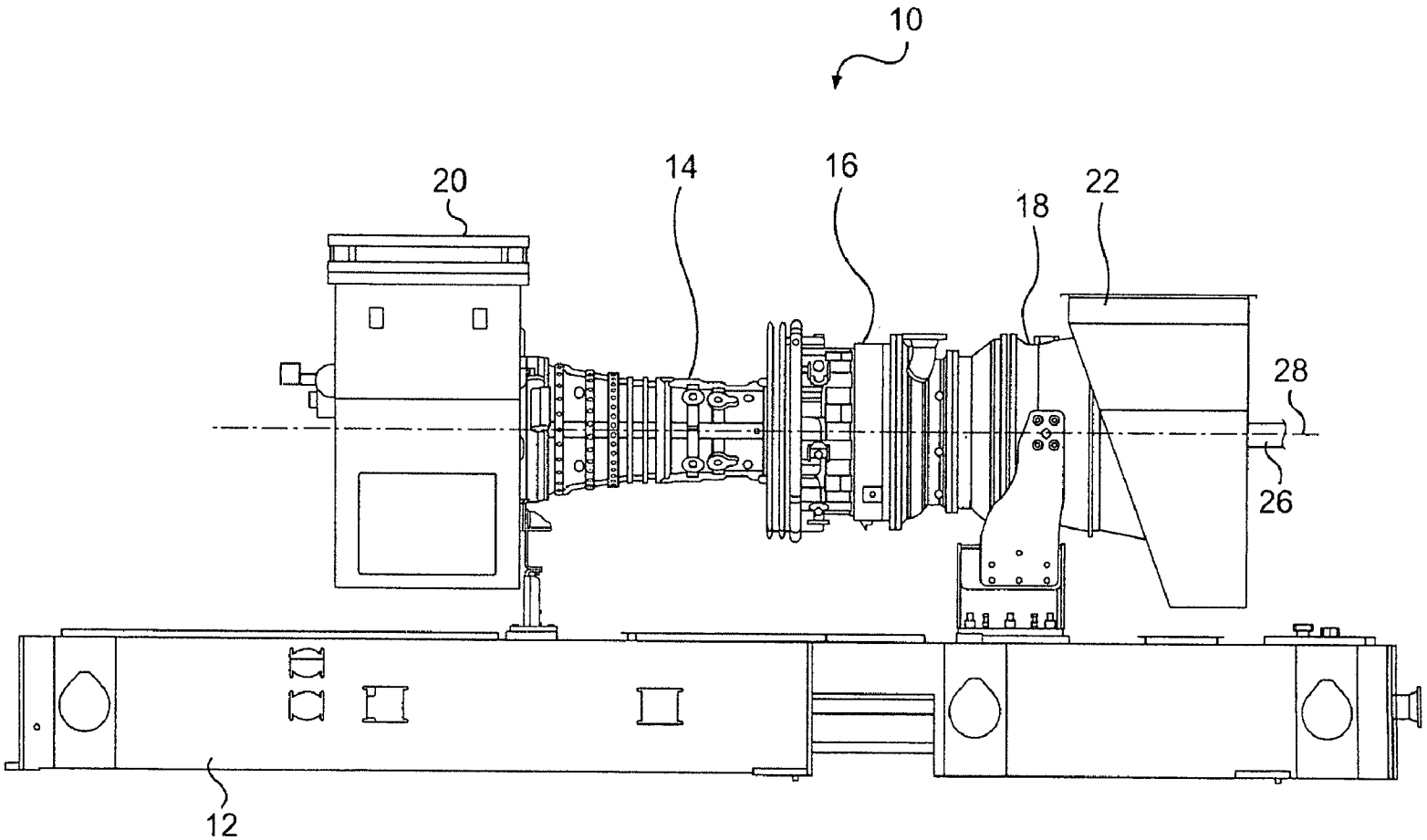
FIG. 1 is a diagrammatic illustration of a GTE mounted on a stationary support structure, in accordance with the present disclosure.

FIG. 1 illustrates a GTE 10 mounted on a stationary support structure 12. GTE 10 may have a plurality of sections, including, for example, a compressor section 14, a combustor section 16, and a turbine section 18. GTE 10 may also include an air inlet duct 20 attached to compressor section 14 and an exhaust collector box 22 attached to turbine section 18.

During operation of GTE 10, compressor section 14 may draw air into GTE 10 through air inlet duct 20 and compress the air before at least a portion of the compressed air enters combustor section 16 to undergo combustion. At least a portion of the of the remaining compressed air (hereinafter referred to as a "flow of cold gases") may be used for noncombustion purposes (e.g. cooling one or more sections of GTE 10) and may travel through GTE 10 separated from the portion of compressed air used for combustion purposes, for example, by a wall (not shown). The portion of the compressed air intended for combustion may mix with fuel, and the air/fuel mixture may be ignited in combustor section 16. The resulting combustion gases (hereinafter referred to as "a flow of hot gases") generated by combustor section 16 may be sent through turbine section 18 to rotate one or more turbine rotor assemblies 24 (one of which is partially shown in FIG. 2) attached to a drive shaft 26 to provide rotary power. After passing through turbine section 18, the flow of hot gases generated by combustor section 16 may be directed into exhaust collector box 22, before being expelled into the atmosphere. Air inlet duct 20, compressor section 14, combustor section 16, turbine section 18, and exhaust collector box 22 may be aligned along a longitudinal axis 28 of GTE 10. The use of the terms "hot" and "cold" in reference to the flow of gases is merely meant to identify that the "the flow of hot gases" is generally at a higher temperature than "the flow of cold gases."

Turbine rotor assembly 24 may rotate drive shaft 26, which may transfer rotational power to a load (not shown), for example, a generator, a compressor, or a pump. A plurality of turbine rotor assemblies 24 may be axially aligned on drive shaft 26 along longitudinal axis 28 to form a plurality of turbine stages. For example, turbine section 18 may include four turbine stages. Each turbine rotor assembly 24 may be mounted on common drive shaft 26, or each turbine rotor assembly 24 may be mounted on separate coaxial drive shafts (not shown).

Figure 2:
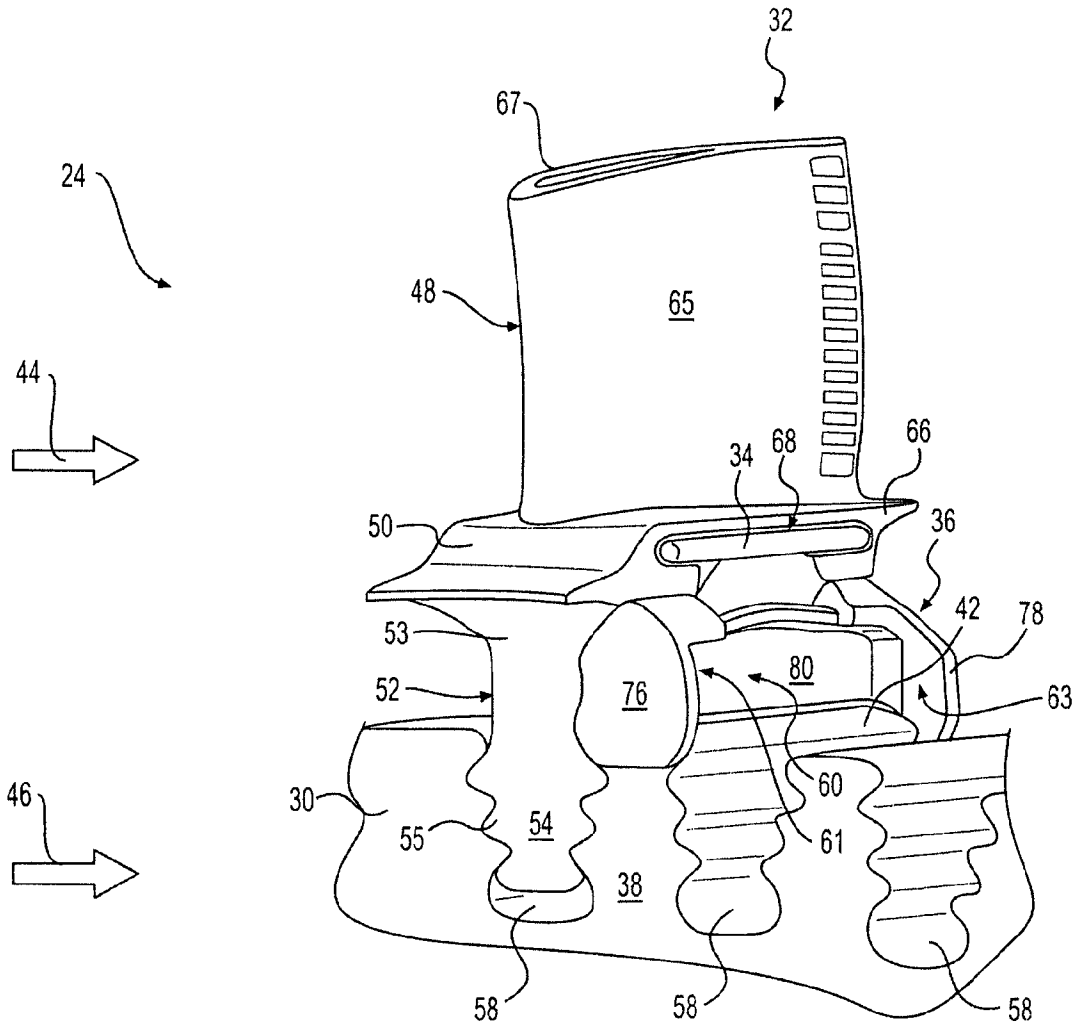
FIG. 2 is a diagrammatic illustration of a partial turbine rotor assembly of the GTE of FIG. 1, including an exemplary turbine damper.
Figure 3:
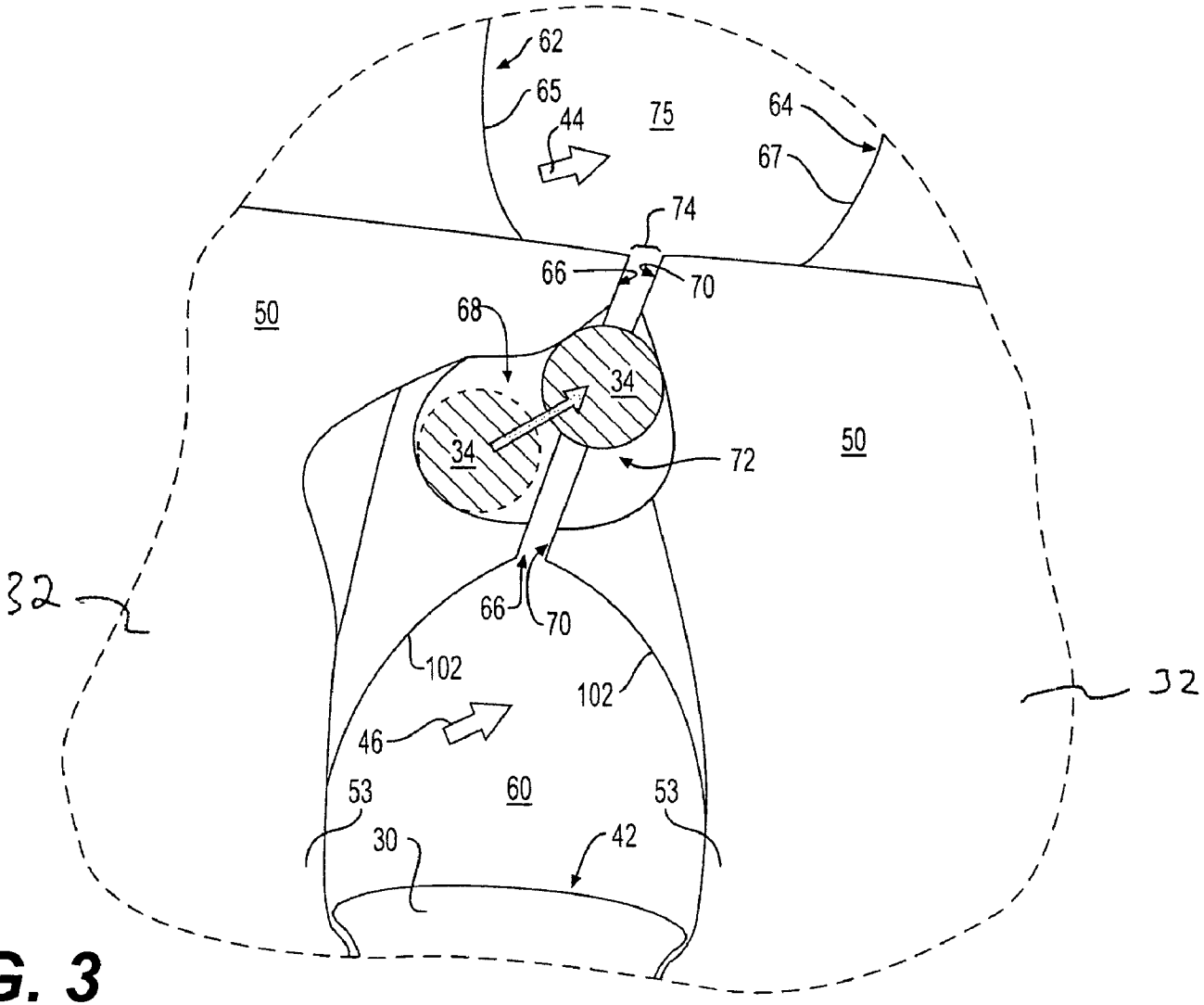
FIG. 3, is a partial cross-sectional view of a pair of adjacent turbine blades of the turbine rotor assembly of FIG. 2.
Figure 4:
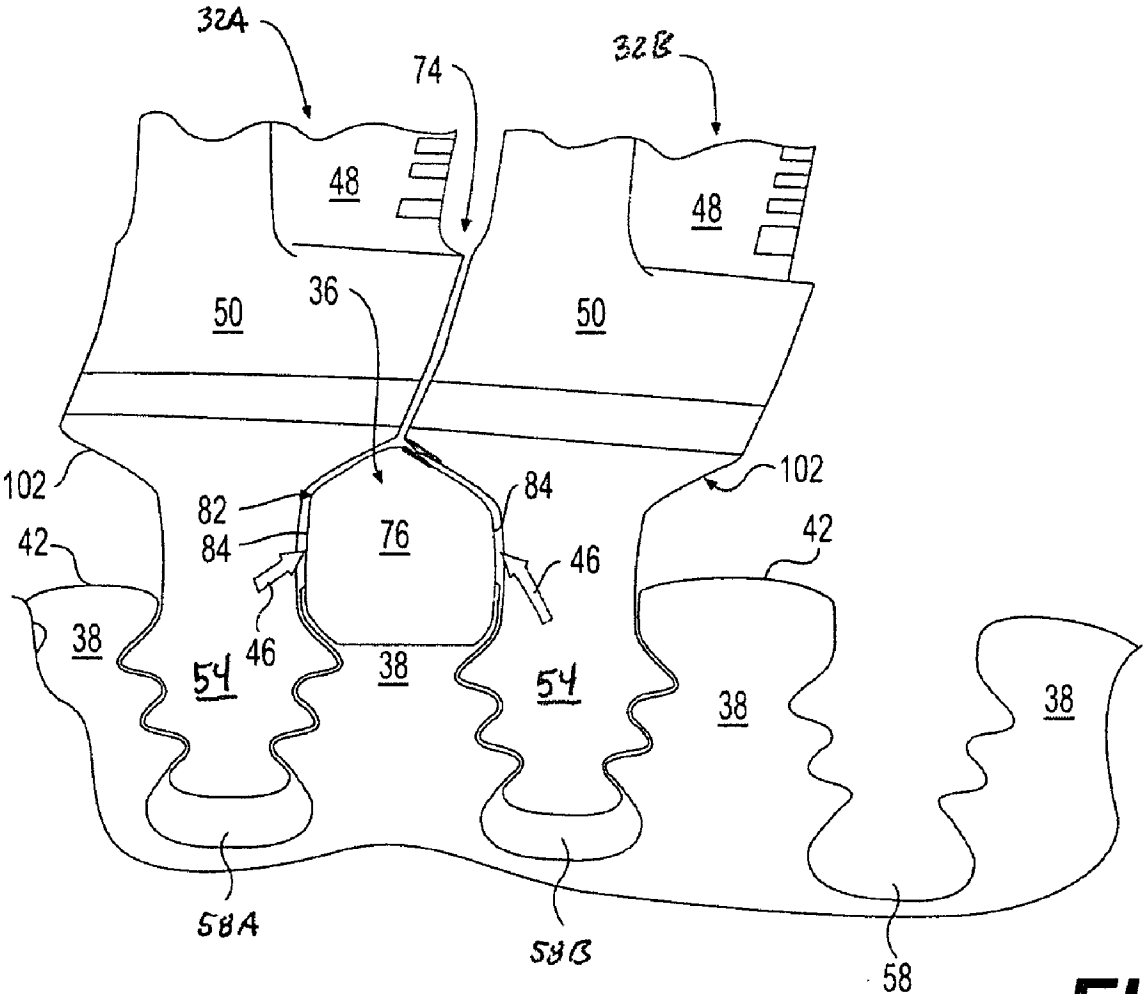
FIG. 4 is a diagrammatic illustration of the turbine rotor assembly of FIG. 2 with an additional turbine blade, looking at a forward face of the turbine rotor assembly in an aft direction along a broach angle of the turbine rotor.
Figure 5:
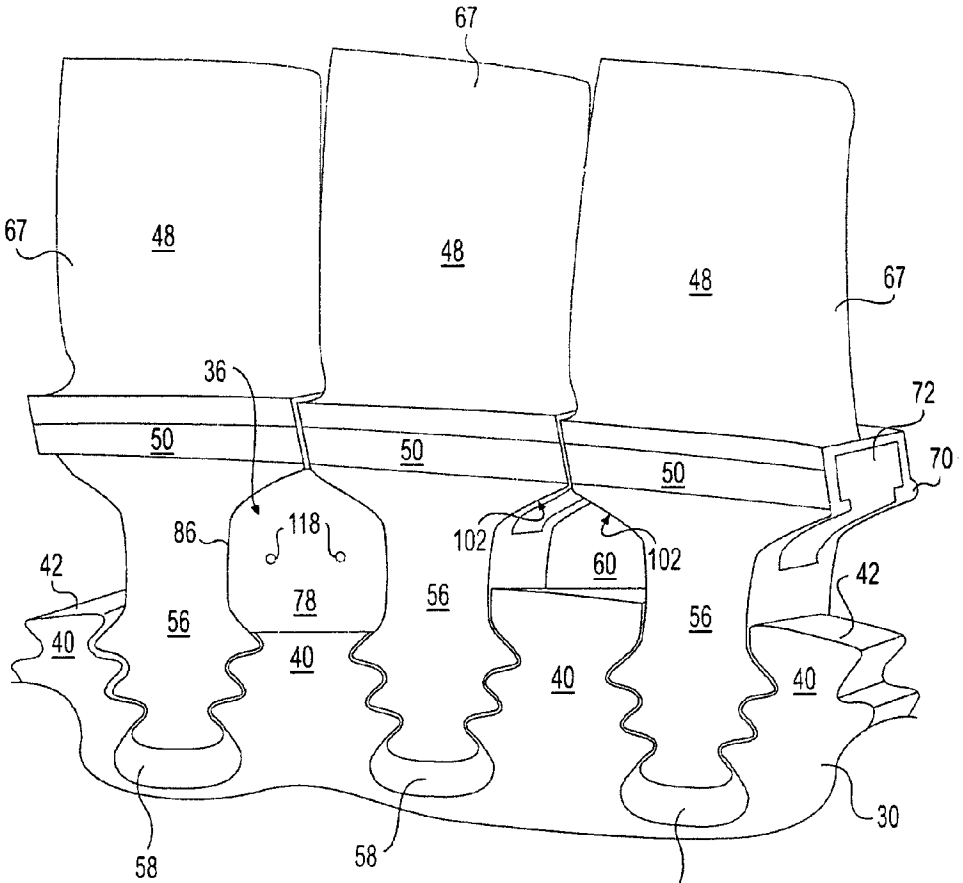
FIG. 5 is a diagrammatic illustration of the turbine rotor assembly of FIG. 2 with two additional turbine blades, looking at an aft face of the turbine rotor assembly in a forward direction along a rotational axis of the turbine rotor.

As shown in FIGS. 2-5, turbine rotor assembly 24 may include various components, including, for example, a turbine rotor 30, a turbine blade 32, a sealing element 34, and a damper 36. FIG. 2 illustrates the relative positions of turbine blade 32, sealing element 34, and damper 36 on turbine rotor 30. FIG. 3 illustrates a partial cross-sectional view of a space formed between adjacent turbine blades 32 and the movement of sealing element 34. FIG. 4 illustrates a forward side of turbine rotor assembly 24 including a damper 36 positioned between a pair of turbine blades 32. FIG. 4 further illustrates that damper 36 may expose a gap 82 for receiving a flow of cold gases 46 around an outer edge 84 of forward plate 76 into an under-platform cavity 60. FIG. 5 illustrates an aft side of turbine rotor assembly 24 including three turbine blades 32 and a damper 36. FIG. 5 further illustrates that damper 36 may restrict the flow of cold gases 46 around an outer edge 86 of aft plate 78, but may allow a small portion of the flow of cold gases 46 to exit under-platform cavity 60 through one or more apertures 118 of aft plate 78.

Although turbine rotor assembly 24 is only partially illustrated in FIG. 2 with a single turbine blade 32, a single sealing element 34, and a single damper 36, it is contemplated that each turbine rotor assembly 24 may include a plurality of turbine blades 32, a plurality of sealing elements 34, and a plurality of dampers 36 positioned circumferentially around turbine rotor 30. Turbine rotor 30 may include a forward face 38, an aft face 40 (shown in FIG. 5), and a circumferential outer edge 42. Turbine rotor 30 may also include a plurality of slots 58 extending through turbine rotor 30, wherein each slot 58 may be configured to secure a corresponding turbine blade 32.

For purposes of this description, the elements referenced as "forward" may be upstream of corresponding elements referenced as "aft." That is, for example, the typical flow of hot gases within GTE 10 will pass "forward" elements before passing "aft" elements. A flow of hot gases, as indicated by arrow 44, and a flow of cold gases, as indicated by arrow 46, may flow through turbine section 18 past turbine rotor assembly 24 in a forward to aft direction. As described above, the flow of hot gases 44 may usually be separated from the flow of cold gases 46 by a wall (not shown).

Each turbine blade 32 may include an airfoil 48 extending up from a turbine platform 50. Further, each turbine blade 32 may also include a root structure 52 extending down from turbine platform 50. Root structure 52 may include a shank 53 and a lower portion 55. Lower portion 55 of root structure 52 may have a shape including a series of projections spaced from each other in the radial direction for receipt in similarly shaped slot 58 of turbine rotor 30. As shown in FIG. 2, root structure 52 may have a fir-tree-type shape. Root structure 52 of turbine blade 32 may include a forward face 54 and an aft face 56 (shown in FIG. 5). When a pair of turbine blades 32 are mounted in adjacent slots 58 of turbine rotor 30, an under-platform cavity 60 (best shown in cross-sectional view of FIG. 3) may be formed between shanks 53 of adjacent root structures 52, below adjacent turbine platforms 50, and above circumferential outer edge 42 of turbine rotor 30. Further, as shown in FIG. 2, under-platform cavity 60 may include a forward end 61 adjacent forward face 38 of turbine rotor 30 and an aft end 63 adjacent aft face 40 of turbine rotor 30.

As best illustrated in FIG. 3, each turbine blade 32 may include a pressure side 62 and a suction side 64. That is, pressure side 62 may be located on a side of turbine blade 32 including a generally concave airfoil surface 65, and suction side 64 may be located on a side of turbine blade 32 including a generally convex airfoil surface 67 (best illustrated in FIG. 5). Each turbine blade 32 may include a pressure side slash face 66 along turbine platform 50. A pressure side pocket 68 may extend into pressure side slash face 66 to house and guide movement of sealing element 34. Likewise, each turbine blade 32 may include a suction side slash face 70 along turbine platform 50. A suction side pocket 72 may extend into suction side slash face 70 to receive a portion of sealing element 34 during operation. For example, during operation of GTE 10, sealing element 34 may move under centrifugal force from a first position (illustrated with dashed lines) within pressure side pocket 68 to a second position (illustrated in solid lines) at least partially within each of pressure side pocket 68 and suction side pocket 72 to bridge a gap 74 separating slash faces 66, 70 of adjacent turbine blades 32. That is, sealing element 34 may serve to regulate the flow of gases 44, 46 through gap 74 between under-platform cavity 60 and a flow path 75 of the flow of hot gases 44 outside of turbine platforms 50. In an exemplary embodiment shown in FIG. 2, sealing element 34 may be a pin seal having a substantially elongated-cylindrical shape. However, sealing element 34 may have any shape or size sufficient to regulate the flow of gases 44, 46 through gap 74.

As best illustrated in FIG. 2, damper 36 may be positioned on turbine rotor 30 to further regulate the flow of gases 44, 46. It is contemplated that damper 36 may be positioned adjacent circumferential outer edge 42 of turbine rotor 30 and between adjacent root structures 52. Damper 36 may include a forward plate 76 connected to an aft plate 78 by a longitudinal structure 80. When damper 36 is mounted on turbine rotor 30, forward plate 76 may be positioned adjacent forward face 38 of turbine rotor 30 and an aft plate 78 may be positioned adjacent aft face 40 of turbine rotor 30. As best illustrated in FIG. 4, forward plate 76 may be sized to permit the flow of cold gases 46 to flow through a gap 82 formed between forward face 54 of adjacent turbine blades 32 and an outer edge 84 of forward plate 76, thereby permitting a portion of the flow of cold gases 46 to enter forward end 61 of under-platform cavity 60. In contrast, as best illustrated in FIG. 5, aft plate 78 may be larger (i.e., have a larger surface area) than forward plate 76 and include an outer edge 86 that extends out farther than outer edge 84 of forward plate 76. Damper 36 may restrict the flow of cold gases 46 flowing around outer edge 86 of aft plate 78 because aft plate 78 may include a surface 88 (shown in FIG. 7) that abuts against aft faces 56 of adjacent turbine blades 32. Hence, aft plate 78 may substantially completely cover aft end 63 of under-platform cavity. Therefore, damper 36 may permit an ingress of cold gases 46 into forward end 61 of under-platform cavity 60 while substantially restricting an egress of cold gases 46 through aft end 63 of under-platform cavity 60, thereby causing a pressure increase within under-platform cavity 60.

Figure 6:
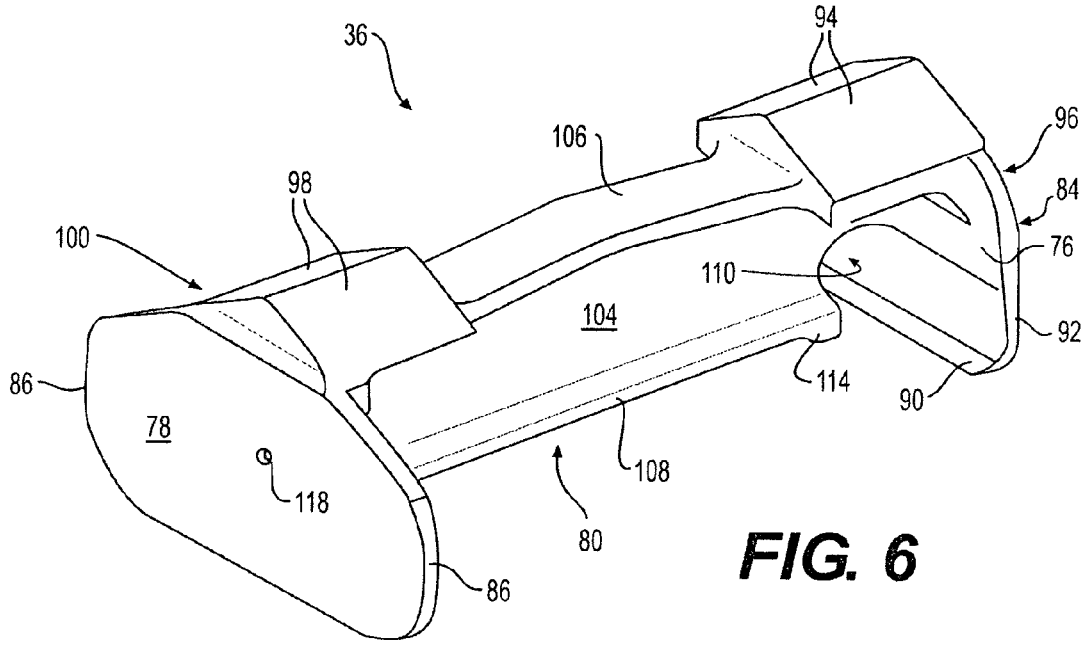
FIG. 6 is a diagrammatic illustration of the exemplary turbine damper of FIG. 2 separate from the turbine rotor assembly.

Damper 36 may be held in place on rotor 30 by a biasing element on one of forward plate 76 and aft plate 78, for example, with a press fit. As best shown in FIG. 6, forward plate 76 may include a biasing lip 90 extending along a distal end of a lower portion 92 of forward plate 76. Biasing lip 90 may tend to force lower portion 92 of forward plate 76 in a direction towards aft plate 78. When damper 36 is mounted on turbine rotor 30, biasing lip 90 may serve to hold damper 36 in place by pressing forward plate 76 against forward face 38 of turbine rotor 30, while pulling aft plate 78 against aft face 40 of turbine rotor 30 and against aft faces 56 of adjacent root structures 52. It is contemplated that lower portion 92 of forward plate 76 may have a tapered thickness to enhance the biasing effect of forward plate 76 and reduce structural stresses on damper 36.

A forward seating surface 94 may extend longitudinally inward of an upper portion of 96 forward plate 76. Similarly, an aft seating surface 98 may extend longitudinally inward of an upper portion of 100 aft plate 78. Forward and aft seating surfaces 94, 98 may be shaped to mate with an underside geometry 102 of turbine platforms 50, such that during operation of GTE 10, radially outward movement of damper 36 due to centrifugal force may be limited by forward and aft seating surfaces 94, 98 contacting underside geometry 102 (best illustrated in FIG. 5) of turbine platforms 50. For example, forward and aft seating surfaces 94, 98 may be wedged-shaped to correspond with the generally wedge-shaped geometry formed by underside geometry 102 of adjacent turbine platforms 50.

Figure 7:
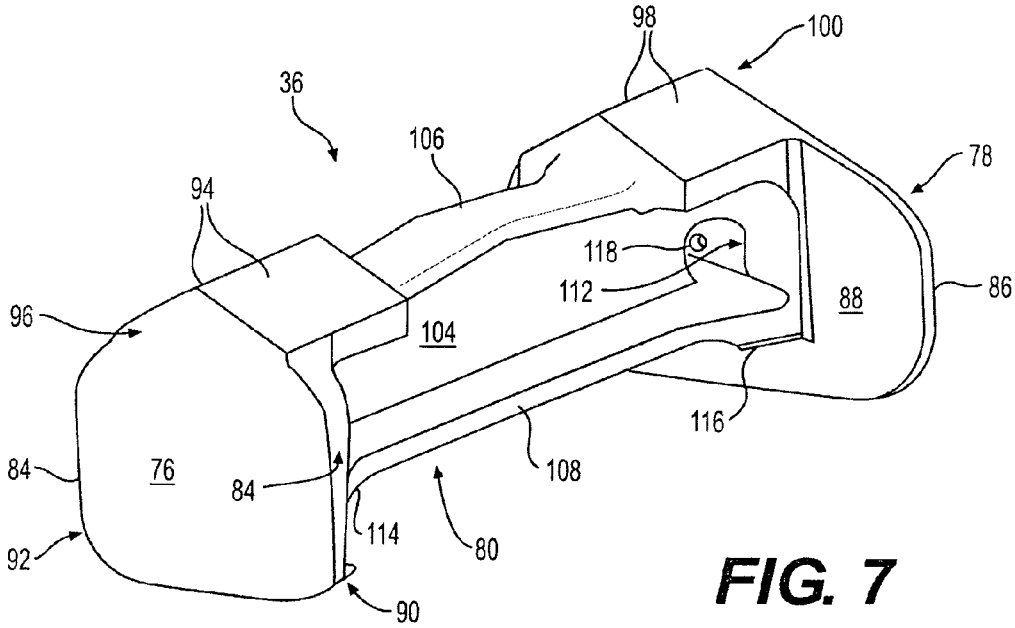
FIG. 7 is a diagrammatic illustration of the exemplary turbine damper of FIG. 6 from an opposite side.

As best illustrated in FIGS. 6 and 7, longitudinal structure 80 of damper 36 may include a central wall 104 and at least one reinforcing structural element. For example, longitudinal structure 80 may include an outer structural element 106 and an inner structural element 108 to provide increased structural rigidity to damper 36. Hence, in an exemplary embodiment, longitudinal structure 80 may be substantially I-shaped in cross-section. Longitudinal structure 80 may include a recess 110 extending, for example, through inner structural element 108 and central wall 104 to aid the biasing characteristics of forward plate 76. Further, recess 110 may be located adjacent forward plate 76, which may increase the range of biasing motion permitted by forward plate 76. Further, longitudinal structure 80 may include one or more passages permitting the flow of gases therethrough. While a single passage 112 is shown within central wall 104 adjacent aft plate 78, any number or orientation of passages 112 within longitudinal structure 80 may be implemented. It is also contemplated that longitudinal structure 80 may include one or more feet to rest on circumferentially outer edge 42 of turbine rotor 30. For example, longitudinal structure 80 may include a forward foot 114 (best illustrated in FIG. 6) and an aft foot 116 (best illustrated in FIG. 7), wherein a flow of gases within under-cavity platform 60 may freely flow beneath longitudinal structure 80 between forward and aft feet 114, 116.

As previously described, aft plate 78 may be sized to substantially restrict the flow of cold gases 46 from exiting under-platform cavity 60 via aft end 63, which may cause an increase in pressure within under-platform cavity 60. As illustrated in FIG. 6, it is also contemplated that aft plate 78 may include one or more apertures 118 to allow some of the flow of cold gases 46 within under-platform cavity 60 to flow through aft plate 78 in a regulated manner, for example, to cool downstream components of GTE 10. Any number or orientation of apertures 118 sufficient to regulate the flow of cold gases 46 to downstream components of GTE 10 may be implemented. It is contemplated that aft wall 78 may include a single aperture 118 centrally located adjacent passage 112. Alternatively, as illustrated in FIG. 5, a plurality of apertures 118 through aft plate 78 may be implemented to regulate the flow of cold gases 46.

It is contemplated that each slot 58 of turbine rotor 30 may include a broach angle. That is, as each slot 58 extends across circumferential outer edge 42 from forward face 38 of turbine rotor 30 to aft face 40 of turbine rotor 30, each slot 58 may be angled relative to forward and aft faces 38, 40 in a circumferential direction. For example, the broach angle of each of the slots 58 of turbine rotor 30 may be angled along a circumferential direction between zero and 25 degrees. In an exemplary embodiment, slot 58 may include a 12 degree broach angle. It is contemplated that each turbine blade 32 and damper 36 may include a matching broach angle relative to its corresponding slot 58 within turbine rotor 30. That is, each root structure 52 of turbine blade 32 may be angled with respect to forward face 54 of root structure 52 to coordinate with the broach angle of its corresponding slot 58. Further, damper 36 may incorporate the broach angle by angling longitudinal structure 80 relative to each of forward plate 76 and aft plate 78 by the broach angle.

While damper 36 is described and shown in the exemplary embodiments of FIGS. 6 and 7, it is contemplated that other configurations of damper 36 may also be implemented. For example, forward plate 76 of damper 36 may include one or more passages (not shown) for further regulating the flow of cold gases 46 into under-platform cavity 60. Further, damper 36 may be used without sealing element 34 or may be used with a different type of sealing element 34.

Industrial Applicability

The disclosed turbine rotor assembly may be applicable to any rotary power system, for example, a GTE. The process of assembling turbine rotor assembly 24 (i.e., including turbine rotor 30, turbine blades 32, sealing elements 34, and dampers 36) and the process of regulating of the flow of gases 44, 46 past turbine rotor assembly 24 will now be described.

During assembly of turbine rotor assembly 24, each damper 36 may be attached to turbine rotor 30, for example, by a press fit. In order to position damper 36 on turbine rotor 30, biasing lip 90 of forward plate 76 may be temporarily forced in a direction away from aft plate 78 to provide sufficient clearance for forward and aft plates 76, 78 of damper 36 to fit over circumferential outer edge 42. Once damper 36 is properly positioned on turbine rotor 30 between one of slots 58, turbine rotor 30 may be sandwiched between forward and aft plates 76, 78.

Turbine blades 32 may be slidably mounted in slots 58 of turbine rotor 30, for example, in a forward-to-aft direction. As shown in FIG. 4, a first turbine blade 32A may be slidably mounted in a first slot 58A of turbine rotor 30 to a side (e.g., a suction side) of one of dampers 36. A sealing element 34 (shown in FIG. 3) may be positioned within pressure side pocket 68 of first turbine blade 32A, for example, prior to installing a second turbine blade 32B. Second turbine blade 32B may be slidably mounted in second slot 58B. As shown in FIG. 4, forward plate 76 of damper 36 may provide sufficient clearance to permit first and second turbine blades 32A, 32B to slide into first and second slots 58A, 58B past damper 36. In lieu of installing all of dampers 36 prior to installing turbine blades 32, it is also contemplated that dampers 36 may be installed on turbine rotor 30 between the installation of adjacent first and second turbine blades 32A, 32B. The process of installing turbine blades 32, sealing element 34, and dampers 36 on turbine rotor 30 to form turbine rotor assembly 24 may be repeated until all slots 58 on turbine rotor 30 are occupied by a turbine blade 32.

Once turbine rotor assembly 24 is fully assembled and GTE 10 is ready for operation, turbine rotor assembly 24 may help regulate the flow of gases 44, 46 through turbine section 18. During operation, the flow of hot gases 44 against turbine blades 32 may cause turbine rotor assembly 24 to rotate. As discussed above, a centrifugal force caused by the rotation of turbine rotor assembly 24 may tend to move sealing element 34 from a first position (shown in dashed lines) outward to a second position (shown in solid lines), where it may span gap 74 and limit the influx of hot gases 44 therethrough.

Further, the flow of cold gases 46 may flow past forward faces 54 of root structures 52 and flow through gap 82, formed between outer edge 84 of forward plate 76 of damper 36 and forward face 54 of adjacent root structures 52, and into forward end 61 of under-platform cavity 60. The flow of cold gases 46 that is permitted to enter under-platform cavity 60 may tend to increase the pressure within under-platform cavity 60 to a higher pressure than outside under-cavity platform 60 (e.g., flow path 75) because surface 88 of aft plate 78 may tend to abut against aft face 56 of root structures 52 to limit the flow of cold gases 46 from exiting aft end 63 of under-platform cavity 60. That is, the flow of cold gases 46 may be more restricted at aft end 63 of under-platform cavity 60 than at forward end 61 of under-platform cavity 60. Therefore, the positive pressure differential generated in under-platform cavity 60, as compared to the lower pressure outside under-platform cavity 60, may tend to suppress the flow of hot gases 44 from entering under-platform cavity 60 through gap 74. Since gas flow tends to move from areas of higher pressure to areas of lower pressure, the flow of cold gases 46 under higher pressure within under-platform cavity 60 may tend to suppress an ingress of the flow of hot gases 44 through gap 74.

Additionally, damper 36 may regulate the flow of cold gases 46 to downstream components of GTE 10, for example, through one or more aft plate apertures 118. In order to maintain a positive pressure within under-platform cavity 60, it is contemplated that gap 82 at forward end 61 of under-platform cavity 60 may be less restrictive than apertures 118 at aft end 63 of under-platform cavity 60.

By employing a damper 36 that creates a positive pressure within under-platform cavity 60 to suppress the ingress of hot gases 44, the disclosed configurations may reduce the likelihood of the flow of hot gases 44 causing premature fatigue of turbine blades 32, for example, near turbine platforms 50. Further, the use of sealing element 34 and damper 36 in combination may further limit the flow of hot gases 44 through gap 74 and into under-platform cavity 60, thereby further reducing the likelihood of the flow of hot gases 44 damaging turbine blades 32.

It will be apparent to those skilled in the art that various modifications and variations can be made to the disclosed turbine blade assembly without departing from the scope of the disclosure. Other embodiments of the turbine blade assembly will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A damper for a turbine rotor assembly of a gas turbine engine, comprising:

a forward plate;

an aft plate including a larger surface area than the forward plate, wherein the aft plate includes at least one aperture for regulating a flow of gas through the aft plate; and a longitudinal structure connecting the forward plate and the aft plate, wherein a lower portion of the forward plate has a tapered thickness in a forward-to-aft direction.

2. The damper of claim 1, wherein the forward plate includes a biasing element configured to secure the damper to a turbine rotor of the turbine rotor assembly.

3. The damper of claim 2, wherein the biasing element extends along a distal edge of the forward plate and includes a biasing lip.

4. The damper of claim 1, wherein the longitudinal structure includes a recess adjacent the forward plate for allowing increased movement of a lower portion of the forward plate.

5. The damper of claim 1, wherein the damper includes a first seating surface extending from the forward plate inwardly toward a center of the longitudinal structure, and a second seating surface extending from the aft plate inwardly toward the center of the longitudinal structure.

6. The damper of claim 5, wherein each of the seating surfaces are wedge-shaped.

7. The damper of claim 1, wherein the aft plate extends out farther from the longitudinal structure than the forward plate.

8. The damper of claim 1, wherein the longitudinal structure is substantially I-shaped in cross-section.

9. The damper of claim 1, wherein the longitudinal structure includes a passage configured to permit gas flow to pass therethrough.

10. The damper of claim 9, wherein the passage in the longitudinal structure is adjacent the aft plate.

11. The damper of claim 1, wherein the at least one aperture in the aft wall includes a plurality of apertures.

12. A turbine rotor assembly for a gas turbine engine, comprising:

a turbine rotor;

a pair of turbine blades mounted to the turbine rotor, the pair of turbine blades forming an under-platform cavity between the pair of turbine blades and the turbine rotor;

a sealing element configured to seal a gap formed between the pair of turbine blades such that a flow of hot gases from outside the under-platform cavity is restricted from entering the under-platform cavity; and a damper positioned within the under-platform cavity, the damper comprising:

a forward plate leaving exposed a gap leading into a forward end of the under-platform cavity between an outer edge of the forward plate and forward faces of the pair of turbine blades;

an aft plate substantially restricting a flow of cold gases from exiting an aft end of the under-platform cavity around an outer edge of the aft plate; and a longitudinal structure connecting the forward plate and the aft plate, wherein the forward plate includes a biasing lip extending along a distal edge of the forward plate and configured to secure the damper to the turbine rotor.

13. The turbine rotor assembly of claim 12, wherein the aft plate includes an aperture for permitting a regulated amount of the flow of cold gases within the under-platform cavity to exit the under-platform cavity and cool downstream components of the gas turbine engine.

14. The turbine rotor assembly of claim 13, wherein the sealing element is a pin seal and the pin seal is configured to move under centrifugal force between a first position within a first turbine blade of the pair of turbine blades to a second position at least partially within the first turbine blade and at least partially within a second turbine blade of the pair of turbine blades.

15. A damper for a turbine rotor assembly of a gas turbine engine, comprising:

a forward plate;

an aft plate including a larger surface area than the forward plate, wherein the aft plate includes at least one aperture for regulating a flow of gas through the aft plate; and a longitudinal structure connecting the forward plate and the aft plate, wherein the forward plate includes a biasing lip extending along a distal edge of the forward plate and configured to secure the damper to a turbine rotor of the turbine rotor assembly.

16. The turbine rotor assembly of claim 12, wherein a lower portion of the forward plate has a tapered thickness in a forward-to-aft direction.

17. The turbine rotor assembly of claim 12, wherein the damper includes a first seating surface extending from the forward plate inwardly toward a center of the longitudinal structure, and a second seating surface extending from the aft plate inwardly toward the center of the longitudinal structure.

18. The turbine rotor assembly of claim 17, wherein each of the seating surfaces are wedge-shaped.

19. The turbine rotor assembly of claim 12, wherein the aft plate extends out farther from the longitudinal structure than the forward plate.

20. The turbine rotor assembly of claim 12, wherein the longitudinal structure includes a recess adjacent the forward plate for allowing increased movement of a lower portion of the forward plate.

* * * * *